US012507729B2

(12) United States Patent
Rothwell

(10) Patent No.: US 12,507,729 B2
(45) Date of Patent: Dec. 30, 2025

(54) RESERVOIR FOR REFILLING AN ARTICLE OF AN AEROSOL PROVISION SYSTEM

(71) Applicant: NICOVENTURES TRADING LIMITED, London (GB)

(72) Inventor: Howard Rothwell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 18/844,532

(22) PCT Filed: Feb. 28, 2023

(86) PCT No.: PCT/GB2023/050449

§ 371 (c)(1),
(2) Date: Sep. 6, 2024

(87) PCT Pub. No.: WO2023/170382

PCT Pub. Date: Sep. 14, 2023

(65) Prior Publication Data

US 2025/0194668 A1 Jun. 19, 2025

(30) Foreign Application Priority Data

Mar. 8, 2022 (GB) ..... 2203171

(51) Int. Cl.
*A24F 15/015* (2020.01)
*A24F 40/10* (2020.01)

(52) U.S. Cl.
CPC ..... *A24F 15/015* (2020.01); *A24F 40/10* (2020.01)

(58) Field of Classification Search
CPC ..... A24F 40/42; A24F 40/10; A24F 15/015; B65D 49/00; B65D 29/00
See application file for complete search history.

(56) References Cited

U.S. PATENT DOCUMENTS 5,045,063 A 9/1991 Spielberg
2003/0175376 A1 9/2003 Jahn
(Continued)

FOREIGN PATENT DOCUMENTS

CN 110250579 A 9/2019
CN 211672443 U 10/2020
(Continued)

OTHER PUBLICATIONS

PCT International Search Report and Written Opinion in International Appln. No. PCT/GB2023/050449, dated Aug. 21, 2023, 13 pages.

*Primary Examiner* — Jason K Niesz
(74) *Attorney, Agent, or Firm* — MERCHANT & GOULD P.C.

(57) ABSTRACT

A reservoir for refilling an article of an aerosol provision system includes a reservoir body configured to store aerosol-generating material, and a moveable component within the reservoir body. The moveable component is configured to move within the reservoir body as aerosol generating material is transferred from the reservoir. In response to the moveable component moving to a predetermined position within the reservoir body, either: a piercing component located on the reservoir body is configured to puncture the moveable component to prevent the reservoir from being refilled with aerosol-generating material; or a piercing component located on the moveable component is configured to puncture the reservoir body to prevent the reservoir from being refilled with aerosol-generating material.

15 Claims, 4 Drawing Sheets

(56) References Cited

U.S. PATENT DOCUMENTS

| | | | | |
|---|---|---|---|---|
| 2016/0029699 | A1 | 2/2016 | Li et al. | |
| 2016/0366946 | A1* | 12/2016 | Murison | B67D 7/02 |
| 2017/0099878 | A1* | 4/2017 | Murison | A24F 15/015 |
| 2019/0110517 | A1 | 4/2019 | Rogers et al. | |
| 2020/0022418 | A1 | 1/2020 | Belisle et al. | |
| 2021/0268210 | A1 | 9/2021 | Klurfeld et al. | |
| 2022/0006130 | A1 | 1/2022 | Guo et al. | |

FOREIGN PATENT DOCUMENTS

| | | | |
|---|---|---|---|
| WO | 2009090083 | A1 | 7/2009 |
| WO | 2014089174 | A2 | 6/2014 |
| WO | 2020188245 | A1 | 9/2020 |

* cited by examiner

RESERVOIR FOR REFILLING AN ARTICLE OF AN AEROSOL PROVISION SYSTEM

RELATED APPLICATIONS

The present application is a National Phase entry of PCT Application No. PCT/GB2023/050449 filed Feb. 28, 2023, which claims priority to GB Application No. 2203171.0 filed Mar. 8, 2022, each of which is hereby incorporated by reference in their entirety.

TECHNICAL FIELD

The present invention relates to a reservoir for refilling an article of an aerosol provision system.

BACKGROUND

Electronic aerosol provision systems such as electronic cigarettes (e-cigarettes) generally contain an aerosol-generating material, such as a reservoir of a source liquid containing a formulation, typically including nicotine, or a solid material such as a tobacco-based product, from which an aerosol is generated for inhalation by a user, for example through heat vaporization. Thus, an aerosol provision system will typically comprise an aerosol generator, e.g. a heating element, arranged to aerosolize a portion of aerosol-generating material to generate an aerosol in an aerosol generation region of an air channel through the aerosol provision system. As a user inhales on the device and electrical power is supplied to the aerosol generator, air is drawn into the device through one or more inlet holes and along the air channel to the aerosol generation region, where the air mixes with the vaporized aerosol generator and forms a condensation aerosol. The air drawn through the aerosol generation region continues along the air channel to a mouthpiece, carrying some of the aerosol with it, and out through the mouthpiece for inhalation by the user.

It is common for aerosol provision systems to comprise a modular assembly, often having two main functional parts, namely an aerosol provision device and an article. Typically the article will comprise the consumable aerosol-generating material and the aerosol generator (heating element), while the aerosol provision device part will comprise longer-life items, such as a rechargeable battery, device control circuitry and user interface features. The aerosol provision device may also be referred to as a reusable part or battery section and the article may also be referred to as a consumable, disposable/replaceable part, cartridge or cartomizer.

The aerosol provision device and article are mechanically coupled together at an interface for use, for example using a screw thread, bayonet, latched or friction fit fixing. When the aerosol-generating material in an article has been exhausted, or the user wishes to switch to a different article having a different aerosol-generating material, the article may be removed from the aerosol provision device and a replacement article may be attached to the device in its place. Alternatively, some articles are configured such that, after the aerosol-generating material in the article has been exhausted, the article can be refilled with more aerosol-generating material, thereby allowing the article to be reused. In this example, the user is able to refill the article using a separate reservoir of aerosol-generating material. The aerosol-generating material used to refill the article may be the same or different to the previous aerosol-generating material in the article, thereby allowing the user to change to a different aerosol-generating material without purchasing a new article.

Refilling the article with aerosol-generating material allows the article to be used with aerosol-generating material that was not in the article when the article was manufactured and sold. This allows the article to be refilled with different types of aerosol-generating material, but allows possible misuse or abuse of the article since it is more ensure that the article is refilled with suitable aerosol-generating material. Refilling the article with aerosol-generating material that was not intended for use with that particular article, or is not suitable for that article, could cause damage to the article and/or harm to the user.

Various approaches are described herein which seek to help address or mitigate some of the issues discussed above.

SUMMARY

The disclosure is defined in the appended claims.

In accordance with some embodiments described herein, there is provided a reservoir for refilling an article of an aerosol provision system comprising a reservoir body configured to store aerosol-generating material, and a moveable component within the reservoir body. The moveable component is configured to move within the reservoir body as aerosol generating material is transferred from the reservoir. In response to the moveable component moving to a predetermined position within the reservoir body, either: a piercing component located on the reservoir body and is configured to puncture the moveable component to prevent the reservoir from being refilled with aerosol-generating material; or a piercing component located on the moveable component is configured to puncture the reservoir body to prevent the reservoir from being refilled with aerosol-generating material.

The reservoir can comprise a reservoir outlet, wherein the aerosol-generating material is transferred from the reservoir through the reservoir outlet. The piercing component located on the reservoir body can comprise a needle. The moveable component comprises a seal and a stopper, the stopper can comprise an opening at the end of the stopper located towards the reservoir outlet, and the needle can be configured to puncture the seal and pass into the opening in at the end of the stopper.

The reservoir body can comprise an opening at a side of the reservoir body opposite the reservoir outlet. The reservoir body can comprise a neck configured to engage with a refilling device, and the reservoir outlet can be located at the neck.

The moveable component can comprise a neck configured to fit inside the neck of the reservoir body. The piercing component located on the reservoir body can comprise a needle at the reservoir outlet configured to puncture an end of the neck of the moveable component located towards the reservoir outlet when the neck of the moveable component is located inside the neck of the reservoir body. The moveable component comprises a seal and a stopper, the neck of the moveable component is located on the seal and the stopper can comprise a neck configured to fit inside the neck of the seal.

The moveable component can be configured to move towards the reservoir outlet as aerosol generating material is transferred from the reservoir.

The predetermined position can be proximate to the reservoir outlet.

The piercing component can be located on the moveable component and comprise-one or more spikes.

In accordance with some embodiments described herein, there is also provided a reservoir for refilling an article of an aerosol provision system, comprising a reservoir body configured to store aerosol-generating material, a moveable component within the reservoir body and configured to move within the reservoir body as aerosol generating material is transferred from the reservoir, wherein at least one of the moveable component and the reservoir body is configured to be punctured to prevent the reservoir from being refilled with aerosol-generating material.

The moveable component and/or the reservoir body can be configured to be punctured by a piercing component on a refill dock for refilling an article of an aerosol provision system.

In accordance with some embodiments described herein, there is also provided a system for refilling an article of an aerosol provision system comprising a refill dock configured to receive a reservoir and comprising a piercing component and the reservoir as described above, wherein the piercing component is configured to puncture at least one of the moveable component and the reservoir body to prevent the reservoir from being refilled with aerosol-generating material.

These aspects and other aspects will be apparent from the following detailed description. In this regard, particular sections of the description are not to be read in isolation from other sections.

BRIEF DESCRIPTION OF DRAWINGS

Embodiments of the invention will now be described, by way of example only, with reference to accompanying drawings, in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of articles and systems discussed herein which are not described in detail may be implemented in accordance with any conventional techniques for implementing such aspects and features.

The present disclosure relates to aerosol provision systems, which may also be referred to as aerosol provision systems, such as e-cigarettes. Throughout the following description the term "e-cigarette" or "electronic cigarette" may sometimes be used, but it will be appreciated this term may be used interchangeably with aerosol provision system and electronic aerosol provision system.

As noted above, aerosol provision systems (e-cigarettes) often comprise a modular assembly including both a reusable part (aerosol provision device) and a replaceable (disposable) or refillable cartridge part, referred to as an article. Systems conforming to this type of two-part modular configuration may generally be referred to as two-part systems or devices. It is also common for electronic cigarettes to have a generally elongate shape. For the sake of providing a concrete example, certain embodiments of the disclosure described herein comprise this kind of generally elongate two-part system employing refillable cartridges. However, it will be appreciated the underlying principles described herein may equally be adopted for other electronic cigarette configurations, for example modular systems comprising more than two parts, as devices conforming to other overall shapes, for example based on so-called box-mod high performance devices that typically have a more boxy shape.

As described above, the present disclosure relates to (but it not limited to) refilling devices for articles of aerosol provision systems, such as e-cigarettes and electronic cigarettes.

Figure 1:
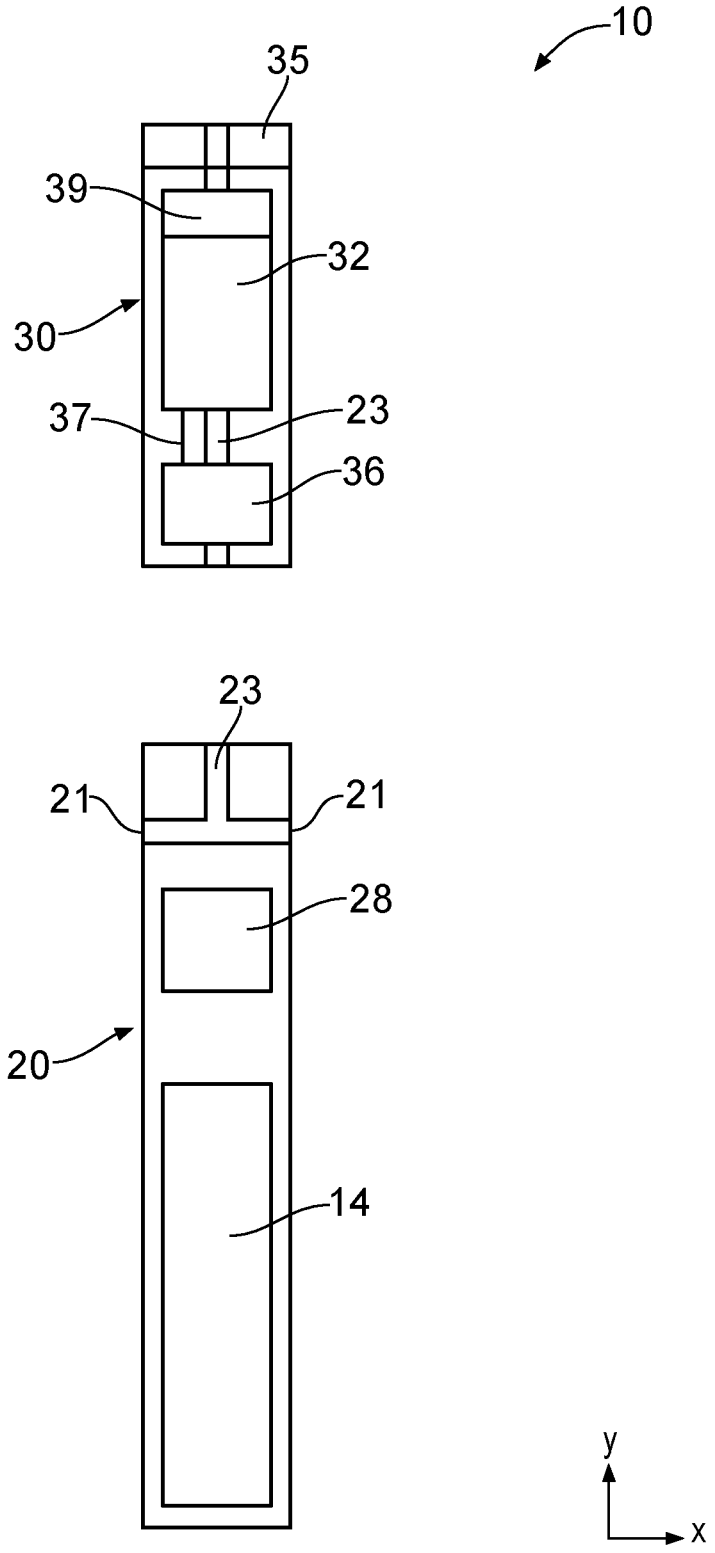
FIG. 1 is a schematic diagram of an aerosol provision system.

FIG. 1 is a highly schematic diagram (not to scale) of an example aerosol provision system 10, such as an e-cigarette, to which embodiments are applicable. The aerosol provision system 10 has a generally cylindrical shape, extending along a longitudinal or y axis as indicated by the axes (although aspects of the invention are applicable to e-cigarettes configured in other shapes and arrangements), and comprises two main components, namely an aerosol provision device 20 and an article 30.

The aerosol provision device 20 and article 30 each comprise an interface 22, 24 such that the aerosol provision device 20 and article 30 are mechanically coupled for use. As described above, the interfaces may comprise a screw thread, bayonet, latched or friction fit fixing, wherein the interface 24 on the aerosol provision device 20 and the interface 24 on the article 30 each comprise a complementary fitting or fixture to enable the aerosol provision device 20 and article 30.

The article 30 comprises or consists of aerosol-generating material 32, part or all of which is intended to be consumed during use by a user. An article 30 may comprise one or more other components, such as an aerosol-generating material storage area 39, an aerosol-generating material transfer component 37, an aerosol generation area, a housing, a wrapper, a mouthpiece 35, a filter and/or an aerosol-modifying agent.

An article 30 may also comprise an aerosol generator 36, such as a heating element, that emits heat to cause the aerosol-generating material 32 to generate aerosol in use. The aerosol generator 36 may, for example, comprise combustible material, a material heatable by electrical conduction, or a susceptor. It should be noted that it is possible for the aerosol generator 36 to be part of the aerosol provision device 20 and the article 30 then may comprise the aerosol-generating material storage area 39 for the aerosol-generating material 32 such that, when the article 30 is coupled with the aerosol provision device 20 via the interfaces 22, 24, the aerosol-generating material 32 can be transferred to the aerosol generator 36 in the aerosol provision device 20.

Aerosol-generating material is a material that is capable of generating aerosol, for example when heated, irradiated or energized in any other way. The aerosol-generating material 32 may, for example, be in the form of a solid, liquid or gel which may or may not contain an active substance and/or flavorants. In some embodiments, the aerosol-generating material 32 may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material 32 may for example comprise from about 50 wt %, 60 wt % or 70 wt % of amorphous solid, to about 90 wt %, 95 wt % or 100 wt % of amorphous solid.

The aerosol-generating material comprises one or more ingredients, such as one or more active substances and/or flavorants, one or more aerosol-former materials, and optionally one or more other functional materials such as pH regulators, coloring agents, preservatives, binders, fillers, stabilizers, and/or antioxidants.

The active substance as used herein may be a physiologically active material, which is a material intended to achieve or enhance a physiological response. The active substance may for example be selected from nutraceuticals, nootropics, and psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

The aerosol provision device 20 includes a power source 14, such as a battery, configured to supply electrical power to the aerosol generator 36. The power source 14 in this example is rechargeable and may be of a conventional type, for example of the kind normally used in electronic cigarettes and other applications requiring provision of relatively high currents over relatively short periods. The battery 14 may be recharged through the charging port (not illustrated), which may, for example, comprise a USB connector.

The aerosol provision device 20 includes device control circuitry 28 configured to control the operation of the aerosol provision system 10 and provide conventional operating functions in line with the established techniques for controlling aerosol provision systems such as electronic cigarettes. The device control circuitry (processor circuitry) 28 may be considered to logically comprise various sub-units/circuitry elements associated with different aspects of the electronic cigarette's operation. For example, depending on the functionality provided in different implementations, the device control circuitry 28 may comprise power source control circuitry for controlling the supply of electrical power from the power source 14 to the aerosol generator 36, user programming circuitry for establishing configuration settings (e.g. user-defined power settings) in response to user input, as well as other functional units/circuitry associated functionality in accordance with the principles described herein and conventional operating aspects of electronic cigarettes. It will be appreciated the functionality of the device control circuitry 28 can be provided in various different ways, for example using one or more suitably programmed programmable computer(s) and/or one or more suitably configured application-specific integrated circuit(s)/circuitry/chip(s)/chipset(s) configured to provide the desired functionality.

The aerosol provision device 20 includes one or more air inlets 21. In use, as a user inhales on the mouthpiece 35, air is drawn into the aerosol provision device 20 through the air inlets 21 and along an air channel 23 to the aerosol generator 36, where the air mixes with the vaporized aerosol-generating material 32 and forms a condensation aerosol. The air drawn through the aerosol generator 36 continues along the air channel 23 to a mouthpiece 35, carrying some of the aerosol with it, and out through the mouthpiece 35 for inhalation by the user. Alternatively, the one or more air inlets 21 may be included on the article 30, such that the air channel 23 is entirely contained within the article 30.

By way of a concrete example, the article 30 comprises a housing (formed, e.g., from a plastics material), an aerosol-generating material storage area 39 formed within the housing for containing the aerosol-generating material 32 (which in this example may be a liquid which may or may not contain nicotine), an aerosol-generating material transfer component 37 (which in this example is a wick formed of e.g., glass or cotton fibers, or a ceramic material configured to transport the liquid from the reservoir using capillary action), an aerosol-generating area containing the aerosol generator 36, and a mouthpiece 35. Although not shown, a filter and/or aerosol modifying agent (such as a flavor imparting material) may be located in, or in proximity to, the mouthpiece 35. The aerosol generator 36 of this example comprises a heater element formed from an electrically resistive material (such as NiCr8020) spirally wrapped around the aerosol-generating material transfer component 37, and located in the air channel 23. The area around the heating element and wick combination is the aerosol-generating area of the article 30.

Figure 2:
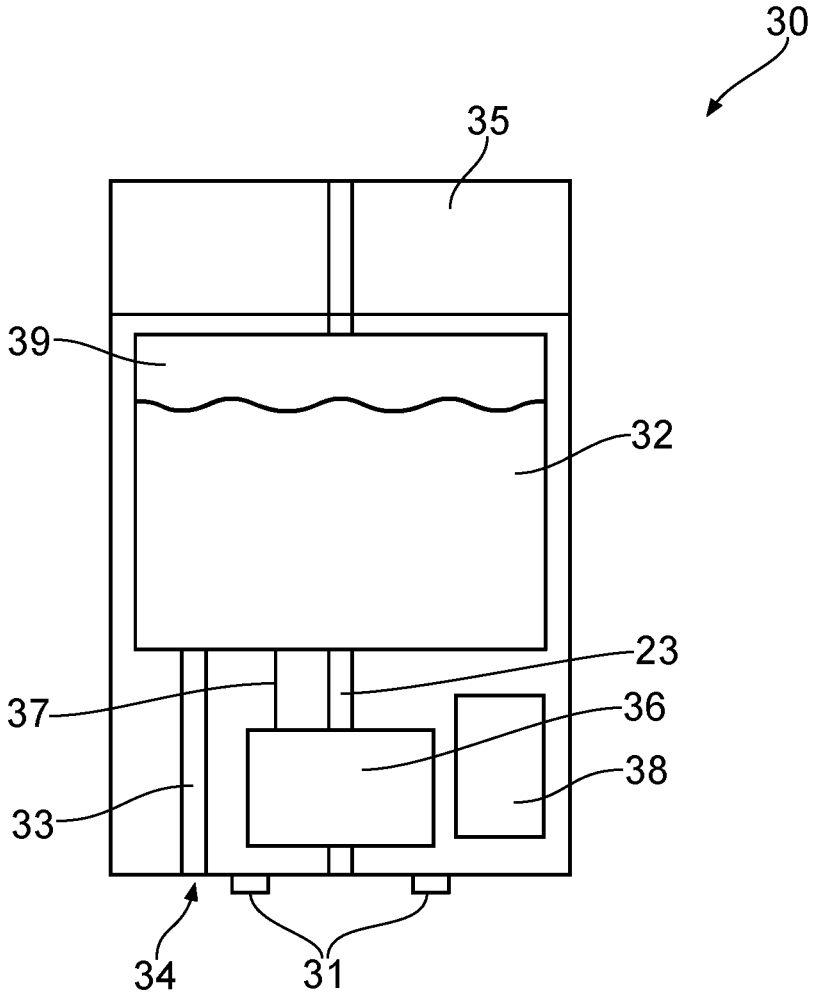
FIG. 2 is a schematic diagram of an example article for use in the aerosol provision system illustrated in FIG. 1.

FIG. 2 is a schematic diagram of an example article 30 for use in the aerosol provision system 10 illustrated in FIG. 1, where the same reference signs have been used for like elements between the article 30 illustrated in FIG. 1 and the article 30 illustrated in FIG. 2. As per the article 30 illustrated in FIG. 1, the article 30 illustrated in FIG. 2 includes an aerosol-generating material storage area 39 for storing an aerosol-generating material 32, an aerosol-generating material transfer component 37, an aerosol generation area containing an aerosol generator 36, and a mouthpiece 35.

The article 30 illustrated in FIG. 2 is configured to be refilled and reused. In other words, the aerosol-generating material storage area 39 of the article 30 illustrated in FIG. 2 can be refilled with aerosol-generating material 32 once some or all of the aerosol-generating material 32 contained in the aerosol-generating material storage area 39 has been exhausted or depleted. To facilitate the refilling or replenishment of aerosol-generating material 32, the article 30 has a refilling tube 33 extending between the aerosol-generating material storage area 39 and the exterior or an outer surface of the housing of the article 30, thereby creating a refilling orifice 34. Aerosol-generating material 32 can then be inserted into the aerosol-generating material storage area 39 via the refilling orifice 34 and refilling tube 33. It will be appreciated, however, that such a configuration of a refilling tube 33 and a refilling orifice 34 is not essential, and the article 30 may comprise any other suitable means of facilitating the refilling of the aerosol-generating material storage area 39 with aerosol generating material 32.

The refilling orifice 34 and/or the refilling tube 33 may be sealable, for example with a cap, one-way valve or septum valve, in order to ensure that aerosol-generating material 32 does not leak out of the refilling orifice 34. In other words, the refilling orifice 34 can comprise a cap, one-way valve or septum valve. Although the refilling orifice 34 is illustrated in FIG. 2 as being on the same end or surface 310 of the article 30 as the air channel 23 and interface 22 with the aerosol provision device 20, this is not essential. The refilling orifice 34 may be located at the end 320 of the article 30 comprising the mouthpiece 35, for example proximate to the outlet of the air channel 23 on the mouthpiece 35, such that the refilling tube 33 extends between the end 320 of the article 30 comprising the mouthpiece 35 and the aerosol-generating material storage area 39. In this case, the article 30 does not necessarily need to be separated from the aerosol-generating device 20 in order to refill the article 30 with aerosol-generating material 32, as the refilling orifice 34 is not obstructed by the aerosol-generating device 20 when the article 30 is coupled with the aerosol provision device 20 via the interfaces 22, 24.

The article 30 illustrated in FIG. 2 also comprises article control circuitry 38 configured to control the operation of the article 30 and store parameters and/or data associated with the article 30. The parameters associated with the article 30 may include, for example, a serial number and/or stock keeping unit (SKU) for the article 30 or other means of identifying the article 30 and/or the type of the article 30, a date of manufacture and/or expiry of the article 30, an indication of the number of times the article 30 has been refilled, the capacity of the aerosol-generating material storage area 39 and/or the amount of aerosol-generating material remaining in the aerosol-generating material storage area 39. The parameters associated with the article 30 may include data relating to the aerosol-generating material stored in the aerosol-generating material storage area 39, such as one or more ingredients, the concentration and/or amount of the ingredients and/or one or more flavorants within the aerosol-generating material. As described above in relation to the device control circuitry 28, the article control circuitry 38 can be provided in various different ways, for example using one or more suitably programmed programmable computer (s) and/or one or more suitably configured application-specific integrated circuit(s)/circuitry/chip(s)/chipset(s) configured to provide the desired functionality. For example, the article control circuitry 38 may comprise a microcontroller unit (MCU) or a system on chip (SoC).

The article 30 illustrated in FIG. 2 also comprises one or more connectors 31, such as contact electrodes, connected via electrical wiring to the aerosol generator 36 and the article control circuitry 38. In use, the article 30 is coupled to the aerosol-generating device 20 and the connectors 31 mate with connectors on the aerosol-generating device, thereby allowing electrical power and electrical current to be supplied from the battery 14 of the aerosol-generating device 20 to the aerosol generator 36 and the article control circuitry 38. As illustrated in FIG. 2, the one or more connectors 31 can be located at the same end 310 of the article 30 as the interface 22. Alternative, the one or more connectors 31 may form part of the interface 22 or be located on a different surface of the article 30 to the interface 22, for example a side wall of the article 30 proximate to the end 310 with the interface. It will be appreciated that the one or more connectors 31 can be located on any surface of the article 30 so as to provide a complementary fixture or fitting with equivalent connectors 22 on the aerosol provision device 20 and/or refilling device 40 as described in more detail below.

Figure 3:
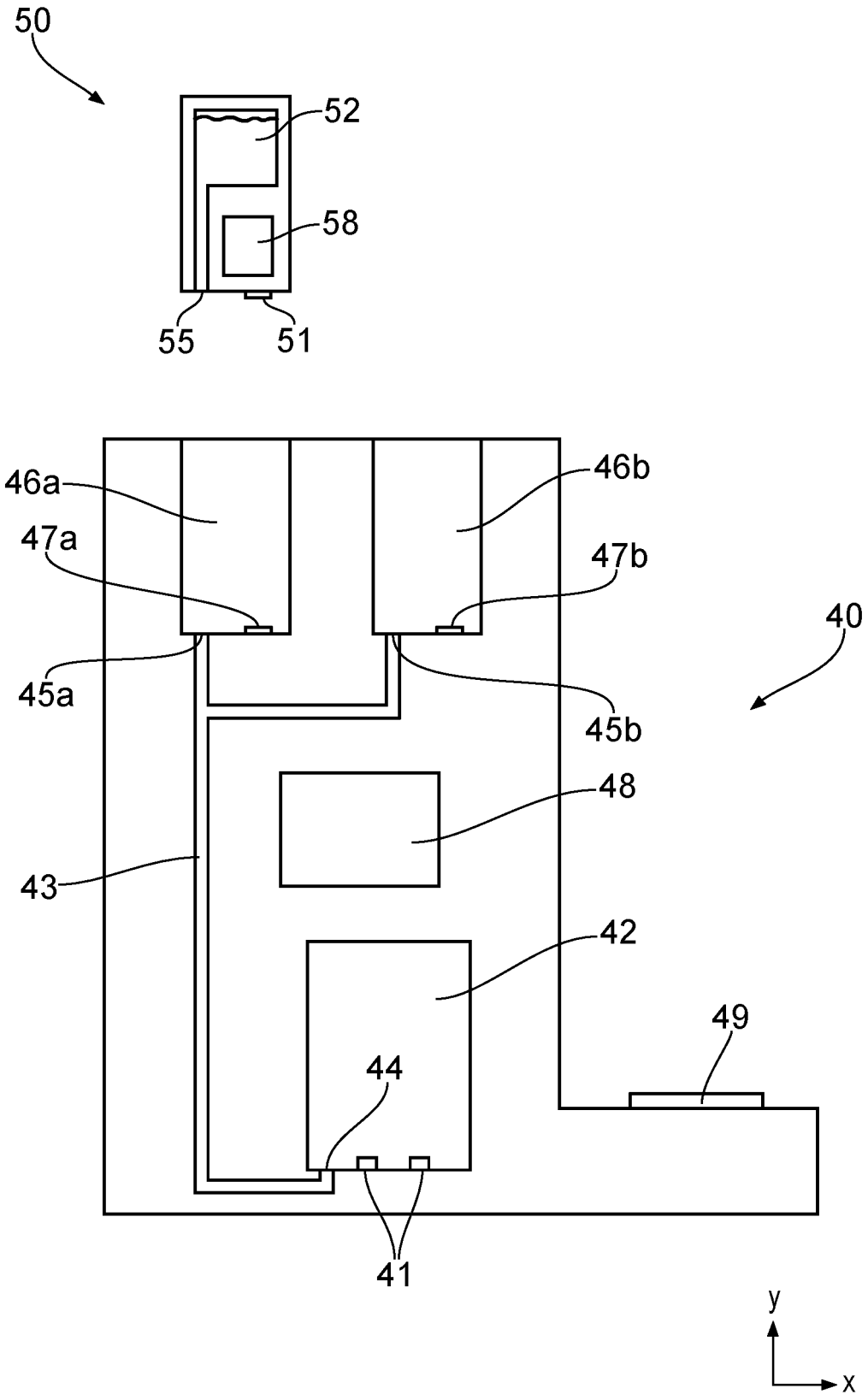
FIG. 3 is a schematic diagram of an example refilling device and a reservoir for refilling the article illustrated in FIG. 2.

FIG. 3 is a schematic diagram of a refilling device 40 for an article of an aerosol provision system, such as the article 30 illustrated in FIG. 2, and a reservoir 50. The reservoir 50 is a disposable/replaceable part which contains aerosol-generating material 52. The refilling device 40 facilitates the transfer of the aerosol-generating material 52 from a reservoir 50 couplable to the refilling device to an article 30 couplable to the refilling device in order to refill or replenish the aerosol-generating material storage area 39 of the article 30 with aerosol-generating material. In other words, the refilling device 40 described herein is a refilling apparatus for an article 30 of an aerosol provision system 10. The article 30 can then be reused as part of the aerosol provision system 10 described above, whilst the reservoir 50 can be disposed of when the aerosol-generating material 52 within the reservoir 50 has been depleted. This allows a single article 30 to be refilled using one or more reservoirs, thereby increasing the number of uses of a single article 30.

The refilling device 40 illustrated in FIG. 3 can be considered a desktop refilling device 40. A desktop refilling device is a refilling device designed for regular use at a single location on or near a desk, table or other solid surface due to its size and power requirements. For example, desktop refilling device 40 can comprise an external power supply, such as a mains power or supply to which the refilling device 40 can be coupled, attached or otherwise connected. The refilling device 40 may also comprise an internal power source, such as a battery, configured to supply electrical power to the components of the refilling device 40 in the event that the external power supply is not available or unexpectedly cuts out in the middle of operation.

As illustrated in FIG. 3, the refilling device 40 can also comprise a flat surface 410 to facilitate storage of the desktop refilling device on another flat surface, such as a desk, table or other solid surface. This allows the desktop refilling device 40 to rest stably and level on another surface. The flat surface 410 may comprise a non-slip mat or coating in order to prevent the desktop refilling device from being knocked or pushed. The non-slip mat may be made of rubber or any other suitable material with a high coefficient of friction. More generally, the desktop refilling device 40 illustrated in FIG. 3 has the flat surface 410 at a first end of the refilling device 40 and a second surface 420 at a second end of the refilling device 40. The second end is opposite the first end, such that a major axis or length of the refilling device 40 extends between the first end and the second end. When the first end and flat surface 410 are placed or otherwise located on a horizontal surface (e.g. aligned with x-axis in FIG. 3), the major axis or length of the refilling device 40 extends in a vertical direction (aligned with the y-axis in FIG. 3) between the first end and the second end. The flat surface 410 can therefore be considered as the base, bottom or foot of the refilling device 40 whilst the second surface 420 can be considered the top or upper surface of the refilling device 40.

As illustrated in FIG. 3, the refilling device 40 comprises an article interface 42 configured to receive the article 30. The article interface 42 may comprise a slot, tray, opening or aperture on the refilling device 40 into or onto which the article 30 is placed or coupled. Alternatively the article interface 42 may comprise a lead or other cable which is attachable or otherwise connectable to the article 30. Although one article interface 42 is illustrated in FIG. 3, the refilling device 40 may comprise more than one article interface 42, for example three, five or ten, depending on the specific design of the refilling device 40. In this case, two or more of the article interfaces 42 may be different such that the refilling device 40 is capable of receiving different types of article, or two or more of the article interfaces 42 may be the same such that the refilling device 40 is capable of receiving multiple articles of the same type.

As illustrated in FIG. 3, the article interface 42 is configured to receive the article 30 when the article 30 is separated from the aerosol provision device 20. As set out above with reference to FIG. 1, when used as an aerosol provision system 10, the aerosol provision device 20 and article 30 are mechanically coupled together via interfaces 22, 24. The article interface 42 is configured such that, before the article 30 is received by the article interface 42, the article is detached, disconnected or otherwise separated from the aerosol provision device 20 such that only the article 30 is received by the article interface 42 (in other words, the aerosol provision system 20 is not received by the article interface 42). This means that the aerosol provision device 20 is not required in order for the article 30 to be refilled with aerosol generating material 32.

The refilling device 40 also comprises one or more reservoir interfaces 46 configured to receive a reservoir 50. In the same fashion as described above in relation to the article interface 42, each of the reservoir interfaces 46 may comprise a slot, tray, opening or aperture on the refilling device 40 into or onto which the reservoir 50 is placed or coupled. Alternatively, each reservoir interface 46 may comprise a lead or other cable which is attachable or otherwise connectable to the reservoir 50. Although two reservoir interfaces 46 are illustrated in FIG. 3, this is not essential and the refilling device 40 may comprise fewer or more reservoir interfaces 46, for example one, three, five or ten, depending on the specific design of the refilling device 40.

As illustrated in FIG. 3, the one or more reservoir interfaces 46 can be located above the article interface 42. In other words the one or more reservoir interfaces 46 are located at a higher position than the article interface 42 such that, in use, the transfer of aerosol-generating material 52 from the reservoir 50 to the article 30 is gravity assisted, thereby reducing the energy required to transfer aerosol-generating material 52. The x-axis shown in FIG. 3 aligns with a horizontal direction and the y-axis shown in FIG. 3 aligns with a vertical direction. A first end of the refilling device 40 comprises the flat surface 410 to allow the refilling device is located on a horizontal surface. As illustrated in FIG. 3, the one or more reservoir interfaces 46 are located further (in other words, a greater distance along the major axis or length of the refilling device 40) from the flat surface 410 than the above the article interface 42. This ensures that, when the flat surface 410 is placed on another flat surface (such as a horizontal surface), such as in the case of a desktop refilling device as described above, the flat surface 410 aligns with the x-axis (or horizontal direction), and the one or more reservoir interfaces 46 are located at a higher position than the article interface 42.

The refilling device 40 also comprises refilling control circuitry 48 configured to control the operation of the refilling device 40. In particular, the refilling control circuitry 48 is configured to facilitate the transfer of aerosol-generating material 52 from a reservoir 50 to the article 30. As described above in relation to the device control circuitry 28, the refilling control circuitry 48 can be provided in various different ways, for example using one or more suitably programmed programmable computer(s) and/or one or more suitably configured application-specific integrated circuit(s)/circuitry/chip(s)/chipset(s) configured to provide the desired functionality. For example, the refilling control circuitry 48 may comprise a microcontroller unit (MCU) or a system on chip (SoC).

The refilling device 40 also comprises a housing 400 which contains and encloses the components of the refilling device 40. As illustrated in FIG. 3, the article interface 42 and the one or more reservoir interfaces 46 are located inside the housing 400 of the refilling device. The article interface 42 is therefore configured to enclose the article 30 and the one or more reservoir interfaces 46 configured to enclose the reservoir 50 inside the housing 400 of the refilling device 40 during the transfer of aerosol-generating material 52 from the reservoir 50 to the article 30. The article interface 42 and/or the reservoir interfaces 46 may comprise a door, cover or flap which can be shut when the article 30 and reservoir 50 are respectively received by the article interface 42 and the one or more reservoir interfaces 46 such that the article 30 and the reservoir 50 are fully contained within or otherwise enclosed by the housing 400 of the refilling device 40.

As described above, the reservoir 50 comprises aerosol-generating material 52 for transferring, by the refilling device 40, to the article 30 in order to refill or replenish the aerosol-generating material 32 in the aerosol-generating material storage area 39 of the article 30.

The reservoir 50 illustrated in FIG. 3 also comprises reservoir control circuitry 58 configured to control the reservoir 50 and store parameters and/or data associated with the reservoir 50. The parameters associated with the reservoir 50 may include, for example data indicative of an amount of aerosol-generating material 52 stored in the reservoir 50, data relating to the aerosol-generating material 52 stored in the reservoir 50, such as one or more ingredients, the concentration and/or amount of the ingredients and/or one or more flavorants within the aerosol-generating material 52. The data may also comprise an identifier, such as a serial number and/or SKU for the reservoir 50 or other means of identifying the reservoir 50 and/or the type of the reservoir 50, and a date of manufacture and/or expiry of the reservoir 50. As described above in relation to the device control circuitry 28, the reservoir control circuitry 58 can be provided in various different ways, for example using one or more suitably programmed programmable computer(s) and/or one or more suitably configured application-specific integrated circuit(s)/circuitry/chip(s)/chipset(s) configured to provide the desired functionality. For example, the reservoir control circuitry 58 may comprise a microcontroller unit (MCU) or a system on chip (SoC). Alternatively, the reservoir control circuitry 58 may comprise a code printed onto the reservoir, such as a barcode or QR code, or an NFC chip or other form of passive tag.

The reservoir 50 can have a volume of 10 ml or more, for example 20 ml, 50 ml or 100 ml. In other words, the reservoir is configured to contain 10 ml or more of aerosol-generating material 52 when the reservoir 50 is filled with aerosol generating material 52. At least one of the one or more reservoir interfaces 46 is then configured to receive a reservoir with a volume of 10 ml or more.

The reservoir 50 can also have a larger volume than the article 30. For example, the volume of the reservoir can be at least 5 times greater than the volume of the article, for example 10 times, 20 times or 50 times greater. In other words, the reservoir is configured to contain, when filled with aerosol-generating material 52, a volume of aerosol-generating material 52 at least 5 times greater than the aerosol-generating material storage area 39 of the article 30. This allows the same reservoir 50 to be used to refill the article at least 5 times. At least one of the one or more reservoir interfaces 46 is then configured to receive a reservoir with a volume at least 5 times greater than a volume of the article the article interface 42 is configured to receive.

The refilling device 40 illustrated in FIG. 3 also comprises one or more connectors 41, such as contact electrodes, connected via electrical wiring to the refilling control circuitry 48 and the power source (not illustrated). The connectors 41 are located proximate to or as part of the article interface 42. This facilitates communication between the refilling control circuitry 48 and the article control circuitry 38; the connectors 31 on the article 30 mate with the connectors 41 on the refilling device 40 when the article 30 is received by the article interface 42, thereby allowing power to be supplied from the refilling device 40 to the article control circuitry 38 and electrical signals to be transferred between the refilling control circuitry 48 and the article control circuitry 38. The connectors 41 may be arranged relative to the article interface 42 in a pattern and position matching/mirroring the connectors 31 on the article 30 in order to facilitate the mating of the connectors 31 on the article 30 and the connectors 41 on the refilling device 40 when the article 30 is received by the article interface 42.

In the same fashion, the refilling device 40 illustrated in FIG. 3 also comprises one or more connectors 47, such as contact electrodes, located proximate to or as part of each of the reservoir interfaces 46 and connected via electrical wiring to the refilling control circuitry 48 and the power source (not illustrated). The connectors 47 mate with the connectors 51 on the reservoir 50 when the reservoir 50 is received by the reservoir interface 46, thereby allowing power to be supplied from the refilling device 40 to the reservoir control circuitry 58 and electrical signals to be transferred between the refilling control circuitry 48 and the reservoir control circuitry 58. The connectors 47 may be arranged relative to the reservoir interface 46 in a pattern and position matching/mirroring the connectors 51 on the reservoir 50 in order to facilitate the mating of the connectors 51 on the reservoir 50 and the connectors 47 on the refilling device 40 when a reservoir 50 is received by one of the reservoir interfaces 46.

Although the connectors 31, 41, 47, 51 are described herein as physical electrical connectors between the article, the refilling device and the reservoir, in an alternative implementation one or more of the electrical connections between the respective components may be a wireless connection, such as NFC, RFID, or inductive coupling.

The refilling device 40 illustrated in FIG. 3 also comprises a refilling outlet 44 located proximate to or as part of the article interface 42, a refilling inlet 45 located proximate to or as part of each of the reservoir interfaces 46, and a duct 43 connecting each refilling inlet 45 to the refilling outlet 44. The refilling outlet 44 is configured to mate with the refilling orifice 34 on the article 30 when the article is received by the article interface 42, and each refilling inlet 45 is configured to mate with a reservoir outlet 55 when a reservoir 50 is received by the corresponding reservoir interface 46. The duct 43 is configured to facilitate the transfer of aerosol-generating material 52 from each of the refilling inlets 45 to the refilling outlet 44, thereby providing a transfer path for aerosol-generating material 52 from the reservoir 50 through the refilling device 40 and into the article 30.

Although the refilling outlet 44 is illustrated in FIG. 3 as being on the same end or surface of the article interface 42 as the connectors 41, this is not essential. The refilling outlet 44 may be located anywhere proximate to or in the article interface 42 relative to the connectors 41 in order for the refilling outlet 44 to mate with the refilling orifice 34 on the article 30 whilst the connectors 41 on the refilling device 40 mate with the connectors 31 on the article 30 when the article 30 is received by the article interface 30. Similarly, the refilling inlet 45 may be located anywhere proximate to or in each reservoir interface 46 relative to the connectors 47 in order for the refilling inlet 45 to mate with the reservoir outlet 55 on the reservoir 50 whilst the connectors 47 on the refilling device 40 mate with the connectors 51 on the reservoir 50 when a reservoir 50 is received by a reservoir interface 46.

Further, as described above, the refilling device 40 may be configured to receive different types, designs or configuration of article 30 using the same article interface 42. In this case, there may be multiple configurations of connectors 41 and/or refilling outlets 44 proximate to or in the article interface 42 in order to facilitate the same article interface 42 receiving different types, designs or configurations of article 30. Equally, there may be multiple configurations of connectors 47 and/or refilling inlets 45 proximate to or in each reservoir interface 46 in order to facilitate the same reservoir interface 46 receiving different types, designs or configurations of reservoir 50. Alternatively or in addition, the configuration of connectors 47 and/or refilling inlets 45 proximate to or in the one or more of the reservoir interfaces 46 may be different such that different reservoir types are received by different reservoir interfaces 46 of the same refilling device 40.

One or more of the refilling outlet 44, the refilling inlets 45, the reservoir outlet 55 and the duct 43 may also include a means of controlling the rate and/or direction of transfer of the aerosol-generating material 52, for example a ball valve, needle valve or diaphragm to control the rate of transfer and/or a one way valve such as a check valve or non-return valve to control the direction of transfer. For example, a one way valve may be located at or proximate to each of the refilling outlet 44, the refilling inlets 45 and the reservoir outlets 55 to ensure that aerosol-generating material 52 can only be transferred from the reservoir 50 to the refilling device 40 and from the refilling device 40 to the article 30, whilst a single ball valve or diaphragm may be located on or in the duct 43 of the refilling device 40 in order to control the flow rate of aerosol-generating material 52 from the reservoir 50 through the refilling device 40 and into the article 30. Equally, a ball valve or diaphragm may be located proximate to each refilling inlet 45 in order to independently control the rate of transfer of aerosol-generating material 52 into each of the refilling inlets 45 or from each of the refilling inlets 45 into the duct 43. For example, this allows the refilling control circuitry 48 to prevent a first aerosol-generating material 52 being transferred from a first reservoir 50 whilst a second aerosol-generating material 52 is being transferred from a second reservoir 50 to the article 30. This also allows the refilling control circuitry 48 to facilitate the transfer the first aerosol-generating material 52 from the first reservoir 50 and the second aerosol-generating material 52 from the second reservoir 50 simultaneously to the article 30, but at different transfer rates, thereby creating an aerosol-generating material 32 in the article 30 containing a mixture of the first aerosol-generating material 52 and the second aerosol-generating material 52 at different concentrations.

The refilling device 40 illustrated in FIG. 3 also comprises a device interface 49 configured to receive the aerosol provision device 20. As described above, the article interface 42 is configured to receive the article 30 when the article 30 is separated from the aerosol provision device 20, such that the aerosol provision device 20 is not received by the article interface 42. The aerosol provision device 20 can then be received by a separate device interface 49 as illustrated in FIG. 3. This allows the device interface 49 and the article interface 42 to be located separately on the refilling device 40, for example on different sides of the refilling device 40, such that the aerosol provision device 20 can be coupled to the refilling device 40 independently of the article 30. As described above, this also means that the aerosol provision device 20 is not required in order for the article 30 to be refilled with aerosol generating material 32.

The device interface 49 can be configured to receive the aerosol provision device 20 in order to supply electrical power from the refilling device 40 to the aerosol provision device 20. This electrical power can be used, for example, to recharge the power source or battery 14 of the aerosol provision device 20 and to facilitate the transfer of electrical signals between the refilling control circuitry 48 and the device control circuitry 28. This allows the user to use the refilling device 40 as a means of charging the aerosol provision device 20 whilst the article 30 is being replenished with aerosol-generating material 32, thereby reducing the number of associated devices needed to operate and maintain the aerosol provision system 10. The device interface 49 may be a wired interface, such as using electrical connectors as described above, or a wireless interface such as inductive or capacitive coupling. The device interface 49 may also be configured to the transfer of data between the refilling control circuitry 48 and the device control circuitry 28. The refilling control circuitry 48 may be configured to read data from the aerosol provision device 20 and/or write data to the aerosol provision device 20, for example to perform a software update, thereby installing an updated version of software onto the device control circuitry 28.

As set out above, the refilling device 40 facilitates the transfer of aerosol-generating material 52 from a reservoir 50 couplable to the refilling device 40 to an article 30 couplable to the refilling device 40 in order to refill or replenish the article 30 so that it can be reused as part of the aerosol provision system 10. In particular, the refilling control circuitry 48 is configured to facilitate the transfer of aerosol-generating material 52 from the reservoir 50 to the article 30 in response to detecting that the article 30 has been received by the refilling device 40.

By way of a concrete example, when a reservoir 50 is received by one of the reservoir interfaces 47, the connectors 47 located proximate to or in the corresponding reservoir interface 46 mate with the connectors 51 on the reservoir 50 and the refilling inlet 45 located proximate to or in the corresponding reservoir interface 46 mates with the reservoir outlet 55. When an article 30 is received by the article interface 42, the connectors 41 located proximate to or in the article interface 42 mate with the connectors 31 on the article 30 and the refilling outlet 45 mates with the refilling orifice 34 on the device 30. The refilling control circuitry 48 is then configured to facilitate the transfer of aerosol-generating material 52 from the reservoir 50 to the article 30 by facilitating the transfer of aerosol-generating material 52 from the reservoir 50 into the duct 42 of the refilling device 40 via the reservoir outlet 51 and the refilling inlet 45, and from the duct 42 of the refilling device 40 into the aerosol-generating material storage area 39 of the article 30 via the refilling outlet 44, the refilling orifice 34 and the refilling tube 33.

In the examples where the refiling device 40 has a plurality of reservoir interfaces 46, the refilling control circuitry 48 is configured to selectively facilitate the transfer of aerosol-generating material 52 from a reservoir 50 received by one of the reservoir interfaces 46, for example in response to a determination that only one of the reservoir interfaces 46 has received a reservoir 50, or in response to a selection of a particular reservoir 50 from which aerosol-generating material 52 should be transferred, for example a user input or a determination based on one or more parameters of each of the reservoirs 50 stored on the respective reservoir control circuitry 58. In this case, the refilling control circuitry 48 is configured to receive, from a user of the refilling device 40, a selection of one or more reservoir interfaces 46 and selectively facilitate the transfer of aerosol-generating material 52, from each reservoir 50 connected to one of the one or more selected reservoir interfaces 46, to the article 30 when the article 30 is coupled to the refilling device. In other words, the refilling control circuitry 48 is configured to only transfer aerosol-generating material 52 from a reservoir 50 connected to a selected reservoir interface 46, and prevent aerosol-generating material 52 from being transferred from any other reservoir 50 connected to the refilling device 40.

Although not illustrated, in some examples, the refilling device 40 can comprise a tank, container or other such receptacle for storing aerosol-generating material 52 received from the reservoir 50, for example when a reservoir 50 is received by the reservoir interface 46 without an article 30 being received by the article interface 42, thereby allowing the reservoir 50 to be disconnected from the reservoir interface 46 before an article 30 is received by the article interface 42. In this case, the aerosol-generating material 52 is stored in the receptacle of the refilling device 40 until such a time that it can be transferred to an article 30 received by the article interface 42. In this case, control circuitry 48 of the refilling device 40 is configured to facilitate the transfer of aerosol-generating material 52 from the reservoir 50 to the receptacle, and subsequently and separately to facilitate the transfer of the aerosol-generating material 52 from the receptacle to the article 42.

The receptacle of the refilling device 40 can also be used to facilitate the mixing of aerosol-generating material 52 before it is transferred to the article 30. For example, if a first reservoir interface 46 receives a first reservoir 50 containing a first aerosol-generating material 52 and a second reservoir interface 46 receives a second reservoir 50 containing a second aerosol-generating material 52, then the refilling control circuitry 48 can be configured to facilitate the transfer of the first aerosol-generating material 52 from the first reservoir 50 into the receptacle, and facilitate the transfer of the second aerosol-generating material 52 from the second reservoir 50 into the receptacle. The first aerosol-generating material 52 and the second aerosol-generating material 52 can then be mixed in the receptacle, and the mixture of the first aerosol-generating material 52 and the second aerosol-generating material 52 transferred to the article 30.

Figure 4C:
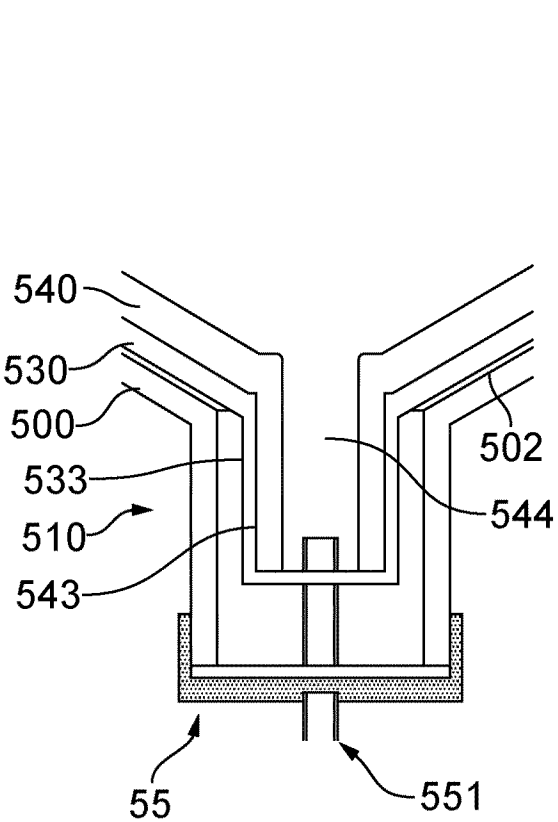
FIGS. 4A to 4C are schematic diagrams of further examples of a reservoir for refilling an article of an aerosol provision system.
Figure 4B:
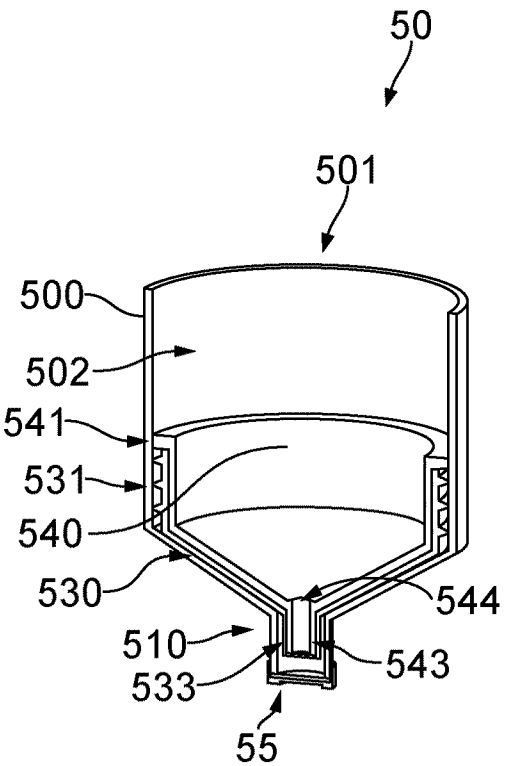
Figure 4A:
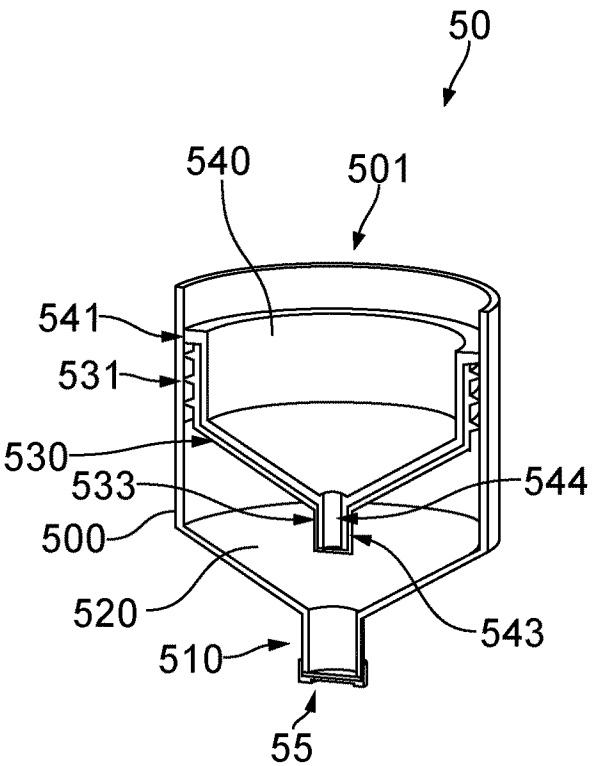

FIGS. 4A to 4C are schematic diagrams of further examples of reservoirs for refilling an article of an aerosol provision system, such as the article 30 illustrated in FIG. 2. The same reference signs have been used for like elements between the reservoir illustrated in FIG. 3 and the reservoirs illustrated in FIGS. 4A to 4C.

The reservoirs 50 illustrated in FIGS. 4A to 4C comprise a reservoir body 500 configured to store aerosol-generating material 52. In other words, the reservoir body 500 provides a housing or container that defines a reservoir storage area 520 for storing aerosol-generating material 52 such that the aerosol-generating material 52 can be contained and stored within the reservoir body 500.

The reservoirs 50 illustrated in FIGS. 4A to 4C each comprise moveable component 530, 540. The moveable component 530, 540 is located within the reservoir body 500. In other words, the moveable component 530, 540 is fully contained inside the reservoir body 500. The moveable component can comprise one of more of a seal 530 and a stopper 540. In other words, the moveable component can be a seal 530 as described in more detail below, a stopper 540 as described in more detail below, or a combination of the seal 530 and the stopper 540 as described in more detail below.

The reservoirs 50 illustrated in FIGS. 4A to 4C each comprise a seal 530 and a stopper 540. The seal 530 and the stopper 540 are each located within the reservoir body 500. In other words, the seal 530 and the stopper 540 are fully contained inside the reservoir body 500. The seal 530 and the stopper 540 form a portion (i.e. a surface that defines the perimeter) of the reservoir storage area 520, such that the volume of the reservoir storage area 520 is defined by the location of the seal 530 and/or the stopper 540 within the reservoir body 500.

The seal 530 comprises one or more fins 531 extending radially outwards from the seal. The fins are configured to abut, touch or otherwise interact with an internal surface 502 of the reservoir body 500 in order to provide a seal that prevents aerosol-generating material 52 from passing around or across the seal 530 or between the seal 530 and the internal surface 502 of the reservoir body 500. For example, the seal 530 can comprise a plurality of fins 531 in order to provide a labyrinth type seal between the seal 530 and the reservoir body 500. The seal 530 therefore provides a leak free surface of the reservoir storage area 520.

The stopper 540 comprises a flange 541 at one end of the stopper, for example the end of the stopper 540 opposite the reservoir outlet 55. The flange 541 extends radially outwards from the stopper and is configured to abut, touch or otherwise interact with the internal surface 502 of the reservoir body 500. The stopper 540 is radially smaller than the seal 530 such that the stopper 540 is substantially located inside the seal 530. For example, the stopper 540 and the seal 530 can both be cup or cone shaped, with the stopper 540 configured to stack inside the seal 530. This allows the seal 530 to be made of a flexible or deformable material, such as rubber or a low density plastics material, whilst the stopper 540 can be made of a more rigid material, such that the seal 530 provides a fluid tight interface between the stopper 540 and the seal 530. The flange 541 is then configured to extend outwards from the stopper 540 (and the seal 530) such that the flange 541 and the fins 531 extend to substantially the same radial position.

As described above, in use, the reservoir 50 is used to refill an article of an aerosol provision system. Aerosol-generating material 52 is transferred from the reservoir 50 through the reservoir outlet 55 (i.e. from the reservoir storage area 520) to the article 30 via a refilling device 40. As aerosol generating material 52 is transferred from the reservoir 50, the moveable component (i.e. the seal 530 and/or the stopper 540) is configured to move within the reservoir body 500, for example towards the reservoir outlet 55. Since the seal 530 and the stopper 540 form a portion of the reservoir storage area 520, the volume of the reservoir storage area 520 will change as aerosol-generating material 52 is transferred from the reservoir 50. For example, aerosol-generating material 52 may be sucked or otherwise drawn out of the reservoir 50. In this case, the seal 530 and the stopper 540 are configured to move within the reservoir body 500 due to the reduction in pressure within the reservoir storage area 520 caused by aerosol-generating material 52 being transferred from the reservoir 50.

In another example, a force can be applied to the seal 530 and/or the stopper 540, for example by a plunger or other moveable component of the refilling device 40, in order to move the seal 530 and the stopper 540 within the reservoir body 500, for example towards the reservoir outlet 55. This movement of the moveable component (the seal 530 and the stopper 540) towards the reservoir outlet 55 reduces the volume of the reservoir storage area 520, thereby increasing the pressure within the reservoir storage area 520, forcing aerosol-generating material 52 to be transferred from the reservoir 50. As illustrated in FIGS. 4A to 4C, the reservoir body 500 can have an opening 501 at one side of the reservoir 50, for example on a side opposite the reservoir outlet 55. A plunger or other moveable component can then be inserted through the opening 501 in order to apply a force to one or more of the seal 530 and the stopper 540, thereby moving the seal 530 and the stopper 540 towards the reservoir outlet 55 as aerosol generating material 52 is transferred from the reservoir 50.

In response to the moveable component moving to a predetermined position within the reservoir body, a piercing component located on the reservoir body is configured to puncture the moveable component to prevent the reservoir from being refilled with aerosol-generating material. In other words, the moveable component (e.g. seal 530) is configured to be pierced, broken or otherwise irreversibly damaged in order to prevent the reservoir 50 from being refilled with aerosol-generating material 52. Alternatively, in response to the moveable component moving to a predetermined position within the reservoir body, a piercing component located on the moveable component is configured to puncture the reservoir body to prevent the reservoir from being refilled with aerosol-generating material. In other words, the moveable component (e.g. stopper 540 and/or seal 530) is configured to pierce, broke or otherwise irreversibly damage the reservoir body 500 in order to prevent the reservoir 50 from being refilled with aerosol-generating material 52. Both these approaches ensure that only the aerosol-generating material 52 originally contained within the reservoir 50 (i.e. the aerosol-generating material 52 provided when the reservoir 50 is manufactured and sold) can be used to refill an article 30 of an aerosol provision system, thereby preventing malicious or incorrect replenishment or refilling of the reservoir 50 with any additional aerosol generating material 52.

The reservoir bodies 500 illustrated in FIGS. 4A to 4C comprise a neck 510 configured to engage with the refilling device 40. The reservoir outlet 55 is then located at the neck 510 such that the aerosol-generating material 52 is transferred from the reservoir 50 via the neck 510. The neck 510 has a smaller cross-sectional area than the rest of the reservoir body 500, such that the neck 510 acts like a funnel around the reservoir outlet 55 to direct aerosol-generating material 52 into the reservoir outlet 55.

Although the reservoir bodies 500 illustrated in FIGS. 4A to 4C are shown to be generally cylindrical in shape and the seal 530 and the stopper 540 are shown to be circular in cross-section, this is not essential, and the reservoir body 500 and moveable component (the seal 530 and/or the stopper 540) may be any shape that can suitably co-operate as described herein. In other words, the reservoir body 500, the seal 530 and the stopper 540 may have any cross-sectional shape provided the cross-sectional shape of the reservoir body 500 and the cross-sectional shape of the seal 530 and the stopper 540 are complementary such that the one or more of the seal 530 and the stopper 540 engage or otherwise interact with an internal surface 502 of the reservoir body 500 as described herein.

FIGS. 4A and 4B illustrate the moveable component (seal 530 and the stopper 540) at different locations within the reservoir body 500 based on the number of times the reservoir 50 has been used to refill an article of an aerosol provision system.

FIG. 4A illustrates the reservoir 50 when it is full of aerosol-generating material 52. In other words, the reservoir is new and has not been used to refill an article of an aerosol provision system. In this case, the seal 530 and the stopper 540 are located proximate to the opening 501 at the first end of the reservoir body 500, such that the reservoir storage area 520 is at its largest possible volume. In other words, the largest possible volume of the reservoir storage area 520 provides a sufficient amount of aerosol-generating material 52 in the reservoir 50 to refill an article of an aerosol provision system as many times as the reservoir is designed to, for example 1, 5, 10 or 20. As described above, a reservoir may be designed to refill an article of an aerosol provision system once, such that the reservoir is a single use reservoir, or the reservoir may be designed to refill an article of an aerosol provision system multiple times, such as 2, 5, 10 or 20.

As described above, the moveable component (seal 530 and the stopper 540) are configured to move within the reservoir body 500 as aerosol generating material 52 is transferred from the reservoir 50. In the examples illustrated in FIGS. 4A and 4B, the seal 530 and the stopper 540 move along the internal surface 502 of the reservoir body 500 towards the neck 510 and the reservoir outlet 55 (and away from the opening 501) as aerosol generating material 52 is transferred from the reservoir 50, thereby reducing the volume of the reservoir storage area 520. As can be seen by comparing FIGS. 4A and 4B, the seal 530 and the stopper 540 in FIG. 4B are located away from the opening 501 in the reservoir body 500 and between the opening 501 in the reservoir body 500 and the neck 510 such that the volume of the reservoir storage area 520 in FIG. 4B is less than the volume of the reservoir storage area 520 in FIG. 4A. FIG. 4B illustrates the reservoir 50 when it has been depleted of aerosol-generating material 52. In other words, the reservoir 50 has been used to refill an article of an aerosol provision system and there is little or no aerosol-generating material 52 remaining in the reservoir 50, such that the reservoir can no longer be used to refill an article of an aerosol provision system. FIG. 4B therefore illustrates the reservoir 50 at the end of its useable life, such that the reservoir 50 should be disposed of and a new or different reservoir 50 used to refill an article of an aerosol provision system. Accordingly, FIG. 4B illustrates the moveable component with the moveable component (the seal 530 and the stopper 540) located at the predetermined position, where the predetermined position corresponds to the location of the moveable component at the end of the useable life of the reservoir. By comparing FIGS. 4A and 4B, it can be seen that the moveable component (the seal 530 and the stopper 540) has moved from the position illustrated in FIG. 4A to the location illustrated in FIG. 4B (the predetermined location). As illustrated in FIG. 4B, the moveable component (the seal 530 and the stopper 540) is located proximate to the neck 510 and the reservoir outlet 55. In other words, the predetermined position is at or proximate to the reservoir outlet, such that the movable component is located at or proximate to the reservoir outlet when the moveable component is in the predetermined position. This means that the reservoir storage area 520 is at its smallest possible volume, which may be zero or a small amount which is effectively zero. In other words, the smallest possible volume of the reservoir storage area 520 is sufficiently small that there is insufficient aerosol-generating material in the reservoir to refill an article of an aerosol provision system.

FIG. 4C shows the neck 510 of the reservoir body 500 in more detail when the seal 530 and the stopper 540 are in the position illustrated in FIG. 4B.

As illustrated in FIGS. 4A to 4C, the moveable component (seal 530) comprises a neck 533 at the end of the seal 530 located towards the reservoir outlet 55, and the stopper 540 comprises a neck 543 at the end of the stopper 540 located towards the reservoir outlet 55. The neck 543 of the stopper 540 has an external size and shape that corresponds to the internal size and shape of the neck 533 of seal 530, such that the neck 543 of the stopper 540 is configured to fit inside the neck 533 of the seal 530. The neck 533 of the moveable component (seal 530) then has an external size and shape that corresponds to the internal size and shape of the inner surface 502 within the neck 510 of the reservoir body 500, such that the neck 533 of the seal 530 is configured to fit inside the neck 510 of the reservoir body 500. In other words, the neck 543 of the stopper 540 and the neck 533 of the seal 530 are located inside the neck 510 of the reservoir body 500 when the reservoir 50 has been depleted of aerosol-generating material 52.

As illustrated in FIG. 4C, the stopper 540 comprises an opening 544 at the end of the stopper 540 located towards the reservoir outlet 55 (i.e. at the end of the neck 543 of the stopper 540). A piercing component 551 located on the reservoir body is then configured to puncture the moveable component (seal 530) to prevent the reservoir from being refilled with aerosol-generating material. The piercing component 551 located on the reservoir body 500 can comprise a needle 551, but it will be appreciated that other piercing components, such as a spike, skewer or stake, can be used to puncture the moveable component. In the example illustrated in FIG. 4C, the piercing component located on the reservoir body 500 comprises a needle 551 located on the reservoir outlet 55 configured to puncture the moveable component (seal 530) to prevent to prevent the reservoir from being refilled with aerosol-generating material. In other words, the needle 551 is configured to pierce, break or otherwise irreversibly damage the moveable component (seal 530) in order to prevent the reservoir from being refilled with aerosol-generating material. For example, the needle 551 can be configured to puncture the seal at the end of the neck 533 of the seal 530 located towards the reservoir outlet 55 and corresponding to the opening 544 at the end of the stopper 540. In other words, the needle 551 is configured to puncture the seal 530 and pass into the opening 544 at the end of the stopper 540. As described above, the seal 530 and the stopper 540 form a portion (i.e. a surface that defines the perimeter) of the reservoir storage area 520. By puncturing the end of the neck 533 of the seal 530 at a location corresponding to the opening 544 at the end of the stopper 540, a flow path is created from the reservoir outlet 55 through the opening 544 at the end of the stopper 540 and to the opening 501 in the reservoir body. This means the reservoir storage area 520 is no longer fluid tight and is unable to retain aerosol-generating material. Accordingly, any attempt to refill the reservoir 50 with aerosol-generating material 52 will cause the aerosol-generating material 52 to leak out of the reservoir 50 through the opening 501 in the reservoir body 500. This therefore prevents the reservoir from being refilled with aerosol-generating material.

The needle 551 is configured to extend from the reservoir outlet 55 (i.e. in a direction towards the opening 501 in the reservoir body 500) by a distance such that the needle 551 only punctures the moveable component (seal 530) when the moveable component (seal 530) is at the predetermined position as illustrated in FIGS. 4B and 4C (i.e. when the neck 543 of the stopper 540 and the neck 533 of the seal 530 are located inside the neck 510 of the reservoir body 500, when the reservoir 50 has been depleted of aerosol-generating material 52). In other words, the needle 551 punctures the end of the neck 533 of the seal 530 located towards the reservoir outlet 55 when the neck 533 of the seal 530 is located inside the neck 510 of the reservoir body 500.

It will be appreciated, however, that the piercing component 551 need not be located in at the reservoir outlet 55. For example, the piercing component may be located on any internal surface of the reservoir body 500, such as a side wall or lower surface of the reservoir body 500 proximate to the neck 510, or in the neck 510 but a distance away from the reservoir outlet 55. There may also be more than one piercing component 551 on the reservoir body 500, for example 2, 5 or 10 in order to ensure that the moveable component is sufficiently punctured or damaged in order to prevent the reservoir from being refilled with aerosol-generating material.

As set out above, the piercing component 551 can be located on the moveable component and configured to puncture the reservoir body 500 to prevent the reservoir from being refilled with aerosol-generating material. For example, the movable component can comprise one or more spikes, needles, skewers or stakes each configured to puncture the reservoir body 500. In this case, the piercing component 551 is located on the movable component such that the piercing component 551 moves with the movable component. When the moveable component moves to the predetermined position, the piercing component 551 contacts and punctures a location on the reservoir body 500, creating a hole. This creates a flow path from the reservoir outlet 55 through the hole created by the piercing component in the reservoir body. This means the reservoir storage area 520 is no longer fluid tight and is unable to retain aerosol-generating material. Accordingly, any attempt to refill the reservoir 50 with aerosol-generating material 52 will cause the movable component to move away from the predetermined position (i.e. towards the opening 501 in the reservoir body 500. The piercing component 551 moves with the moveable component, thereby opening up the hole in the reservoir body 500 such that aerosol-generating material 52 can leak out of the reservoir 50 through the hole in the reservoir body 500. This therefore prevents the reservoir from being refilled with aerosol-generating material.

In other words, at least one of the moveable component and the reservoir body 500 is configured to be punctured to prevent the reservoir 50 from being refilled with aerosol-generating material 52. In some cases, the moveable component and/or the reservoir body 500 is configured to be punctured by a piercing component on a refill dock for refilling an article of an aerosol provision system, such as the refilling device 40 described above. For example, the piercing component can be located on the reservoir interface 46 such that the reservoir body 500 is pierced by the piercing component when the reservoir 50 is received by the reservoir interface 46. Alternatively, the piercing arrangement described above with reference to FIGS. 4A to 4C may take place, but with the piercing component located on the reservoir interface 46 rather than the reservoir outlet.

As described above, the present disclosure relates to (but it not limited to) a reservoir for refilling an article of an aerosol provision system, comprising a reservoir body configured to store aerosol-generating material, and a moveable component within the reservoir body. The moveable component is configured to move within the reservoir body as aerosol generating material is transferred from the reservoir. In response to the moveable component moving to a predetermined position within the reservoir body, either: a piercing component located on the reservoir body is configured to puncture the moveable component to prevent the reservoir from being refilled with aerosol-generating material; or a piercing component located on the moveable component is configured to puncture the reservoir body to prevent the reservoir from being refilled with aerosol-generating material.

Thus, there has been described a reservoir for refilling an article of an aerosol provision system.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A reservoir for refilling an article of an aerosol provision system, comprising:

a reservoir body configured to store aerosol-generating material;

a moveable component within the reservoir body and configured to move within the reservoir body as aerosol generating material is transferred from the reservoir, wherein, in response to the moveable component moving to a predetermined position within the reservoir body, either:

a piercing component located on the reservoir body is configured to puncture the moveable component to prevent the reservoir from being refilled with aerosol-generating material; or a piercing component located on the moveable component is configured to puncture the reservoir body to prevent the reservoir from being refilled with aerosol-generating material.

2. The reservoir of claim 1, wherein the piercing component located on the moveable component comprises one or more spikes.

3. The reservoir of claim 1, further comprising a reservoir outlet, wherein aerosol-generating material is transferred from the reservoir through the reservoir outlet.

4. The reservoir of claim 3, wherein the reservoir body comprises an opening at a side of the reservoir body opposite the reservoir outlet.

5. The reservoir of claim 3, wherein the moveable component is configured to move towards the reservoir outlet as aerosol generating material is transferred from the reservoir.

6. The reservoir of claim 3, wherein the predetermined position is at or proximate to the reservoir outlet.

7. The reservoir of claim 3, wherein the piercing component located on the reservoir body comprises a needle.

8. The reservoir of claim 7, wherein the moveable component comprises a seal and a stopper, the stopper comprises an opening at the end of the stopper located towards the reservoir outlet, and wherein the needle is configured to puncture the seal and pass into the opening in at the end of the stopper.

9. The reservoir of claim 3, wherein the reservoir body comprises a neck configured to engage with a refilling device, and the reservoir outlet is located at the neck.

10. The reservoir of claim 9, wherein the moveable component comprises a neck configured to fit inside the neck of the reservoir body.

11. The reservoir of claim 10, wherein the piercing component located on the reservoir body comprises a needle at the reservoir outlet configured to puncture an end of the neck of the moveable component located towards the reservoir outlet when the neck of the moveable component is located inside the neck of the reservoir body.

12. The reservoir of claim 10, wherein the moveable component comprises a seal and a stopper, the neck of the moveable component is located on the seal and the stopper comprises a neck configured to fit inside the neck of the seal.

13. A reservoir for refilling an article of an aerosol provision system, comprising:

a reservoir body configured to store aerosol-generating material;

a moveable component within the reservoir body and configured to move within the reservoir body as aerosol generating material is transferred from the reservoir, wherein at least one of the moveable component and the reservoir body is configured to be punctured to prevent the reservoir from being refilled with aerosol-generating material.

14. The reservoir of claim 13, wherein the moveable component and/or the reservoir body is configured to be punctured by a piercing component on a refill dock for refilling an article of an aerosol provision system.

15. A system for refilling an article of an aerosol provision system comprising:

a refill dock configured to receive a reservoir and comprising a piercing component; and the reservoir of claim 13, wherein the piercing component is configured to puncture at least one of the moveable component and the reservoir body to prevent the reservoir from being refilled with aerosol-generating material.

* * * * *